US006085765A

United States Patent [19]

Sigsworth

[11] Patent Number: 6,085,765

[45] Date of Patent: Jul. 11, 2000

[54] FOREARM CRUTCH CUSHION SYSTEM

[76] Inventor: Joanne D. Sigsworth, 4713 Dreyfous Ave., Metairie, La. 70006

[21] Appl. No.: 09/187,972

[22] Filed: Nov. 6, 1998

[51] Int. Cl.[7] ..... A61H 3/02

[52] U.S. Cl. ..... 135/68; 135/71; 135/72; 482/75; 602/62; 602/21; 128/878

[58] Field of Search ..... 135/71, 72, 73, 135/65, 66, 68, 76; 224/901, 901.2, 658, 642, 229; 602/20, 21, 26, 62; 623/27, 28; 482/75–76; 128/878, 882

[56] References Cited

U.S. PATENT DOCUMENTS

| | | | |
|---|---|---|---|
| 2,873,752 | 2/1959 | Senour . | |
| 3,213,870 | 10/1965 | Kiehn . | |
| 3,626,519 | 12/1971 | Baker | 482/75 X |
| 4,248,256 | 2/1981 | Thomas | 135/71 X |
| 4,440,525 | 4/1984 | Perla | 224/229 X |
| 4,869,280 | 9/1989 | Ewing | 135/69 |
| 5,038,811 | 8/1991 | Gilmore | 135/71 |
| 5,074,795 | 12/1991 | Clark | 119/96 X |
| 5,178,595 | 1/1993 | MacGregor | 135/68 X |
| 5,224,924 | 7/1993 | Urso | 602/19 |
| 5,482,070 | 1/1996 | Kelly . | |
| 5,555,904 | 9/1996 | Stockwell . | |
| 5,560,382 | 10/1996 | Wagner . | |
| 5,671,765 | 9/1997 | Hagberg, Jr. | 135/71 X |

FOREIGN PATENT DOCUMENTS

| | | | |
|---|---|---|---|
| 1503809 | 8/1989 | U.S.S.R. | 135/68 |

*Primary Examiner*—Carl D. Friedman
*Assistant Examiner*—Winnie Yip
*Attorney, Agent, or Firm*—Joseph N. Breaux

[57] ABSTRACT

A forearm crutch cushion system that includes an arm cradle cushion assembly and a hand grip cushion assembly. The arm cradle cushion assembly including a rectangular shaped, padded forearm contact section, left and right rectangular top fold-over securing sections formed along a top edge of the padded forearm contact section, left and right rectangular bottom fold-over securing sections formed along a bottom edge of the padded forearm contact section, and rectangular, left and right cradle end cover sections formed respectively in connection with left and right side edges of the padded forearm contact section.

1 Claim, 4 Drawing Sheets

FIG. 1
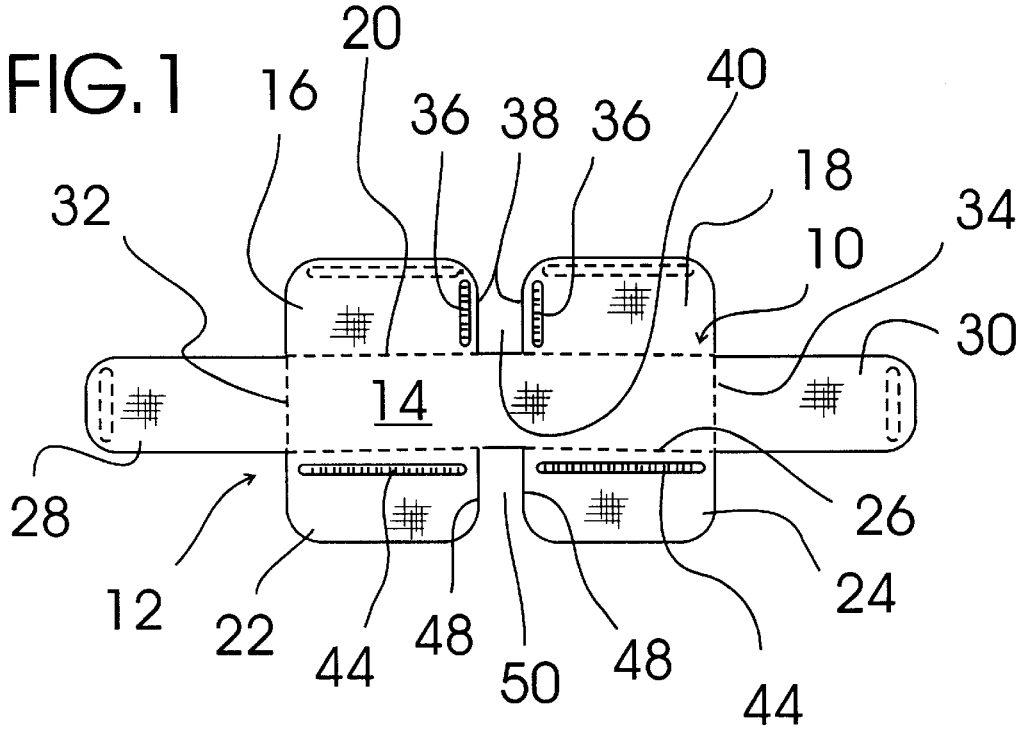
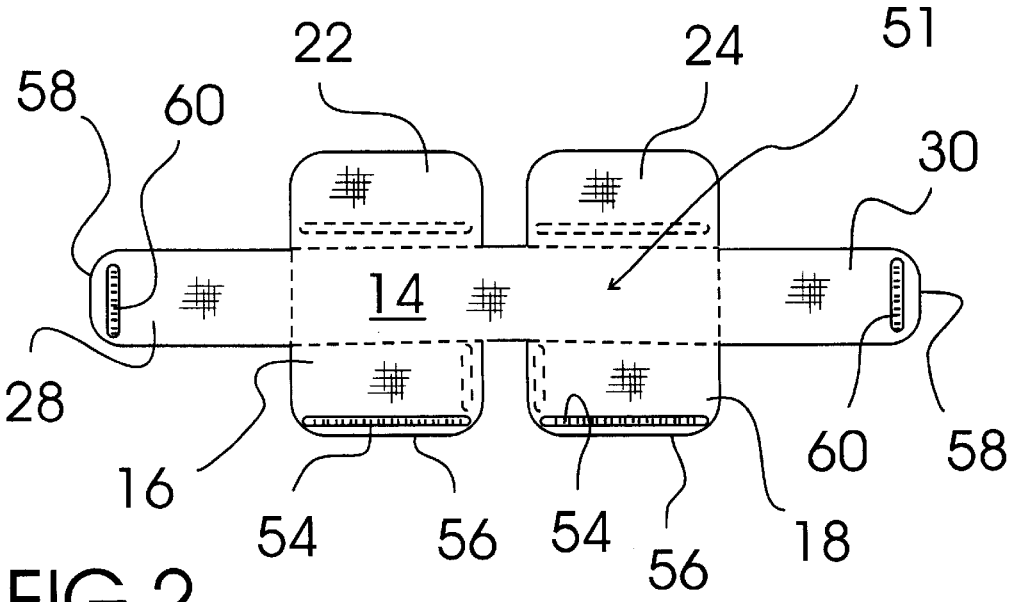
FIG. 2

FOREARM CRUTCH CUSHION SYSTEM

TECHNICAL FIELD

The present invention relates to cushions for crutches and the like and more particularly to a forearm crutch cushion system including an arm cradle cushion assembly and a hand grip cushion assembly; the arm cradle cushion assembly including a rectangular shaped, padded forearm contact section having an interior facing surface; left and right rectangular top fold-over securing sections formed along a top edge of the padded forearm contact section, each top fold-over securing section having an interior facing surface having a cradle end attaching hook and pile fastener section provided along each of two parallel oriented, top fold-over spaced facing edges thereof that are perpendicular to the top edge of the forearm contact section, the two top fold-over spaced facing edges defining a top vertical support pole notch therebetween; left and right rectangular bottom fold-over securing sections formed along a bottom edge of the padded forearm contact section, each bottom fold-over securing section having an interior facing surface having a hook and pile fastener strip provided thereon that is collinearly oriented with the hook and pile fastener strip provided on the interior facing surface of the other bottom fold-over securing section, both hook and pile fastener strips being positioned adjacent to the bottom edge of the padded forearm contact section, the left and right bottom fold-over securing sections having two parallel oriented, bottom fold-over spaced facing side edges that are each collinear with one of the two top fold-over spaced facing edges and that define a bottom vertical support pole notch; and rectangular, left and right cradle end cover sections formed respectively in connection with left and right side edges of the padded forearm contact section; the exterior side of the left and right rectangular top fold-over securing sections having top fold-over securing section edges having top hook and pile fastener strips provided adjacent thereto that are each companionate with the hook and pile fastener strips of the bottom fold-over securing sections; the left and right cradle end cover sections each having a far end provided with a cradle end hook and pile fastener section on the exterior side thereof that is companionate with the cradle end attaching hook and pile fastener sections of the top fold-over securing sections; the hand grip cushion assembly including a rectangular shaped, padded hand grip section with an interior side hand grip hook and pile faster strip provided along a bottom edge thereof and an exterior side hand grip hook and pile faster strip provided along the top edge thereof that is companionate with the interior hand grip hook and pile faster strip; the hand grip cushion assembly including first and second vertical crutch support pole securing straps that are attachable together at the far ends thereof with strap hook and pile fastener sections.

BACKGROUND ART

Because much of the user's weight is supported by the hands and forearms when using forearm crutches, it can painful to the user's hands and forearms. It would be a benefit, therefore to have a forearm crutch cushion system that includes an arm cradle cushion assembly and a hand grip cushion assembly.

GENERAL SUMMARY DISCUSSION OF INVENTION

It is thus an object of the invention to provide a forearm crutch cushion system that includes an arm cradle cushion assembly and a hand grip cushion assembly.

It is a further object of the invention to provide a forearm crutch cushion system that includes an arm cradle cushion assembly and a hand grip cushion assembly; the arm cradle cushion assembly including a rectangular shaped, padded forearm contact section having an interior facing surface; left and right rectangular top fold-over securing sections formed along a top edge of the padded forearm contact section, each top fold-over securing section having an interior facing surface having a cradle end attaching hook and pile fastener section provided along each of two parallel oriented, top fold-over spaced facing edges thereof that are perpendicular to the top edge of the forearm contact section, the two top fold-over spaced facing edges defining a top vertical support pole notch therebetween; left and right rectangular bottom fold-over securing sections formed along a bottom edge of the padded forearm contact section, each bottom fold-over securing section having an interior facing surface having a hook and pile fastener strip provided thereon that is collinearly oriented with the hook and pile fastener strip provided on the interior facing surface of the other bottom fold-over securing section, both hook and pile fastener strips being positioned adjacent to the bottom edge of the padded forearm contact section, the left and right bottom fold-over securing sections having two parallel oriented, bottom fold-over spaced facing side edges that are each collinear with one of the two top fold-over spaced facing edges and that define a bottom vertical support pole notch; and rectangular, left and right cradle end cover sections formed respectively in connection with left and right side edges of the padded forearm contact section; the exterior side of the left and right rectangular top fold-over securing sections having top fold-over securing section edges having top hook and pile fastener strips provided adjacent thereto that are each companionate with the hook and pile fastener strips of the bottom fold-over securing sections; the left and right cradle end cover sections each having a far end provided with a cradle end hook and pile fastener section on the exterior side thereof that is companionate with the cradle end attaching hook and pile fastener sections of the top fold-over securing sections; the hand grip cushion assembly including a rectangular shaped, padded hand grip section with an interior side hand grip hook and pile faster strip provided along a bottom edge thereof and an exterior side hand grip hook and pile faster strip provided along the top edge thereof that is companionate with the interior hand grip hook and pile faster strip; the hand grip cushion assembly including first and second vertical crutch support pole securing straps that are attachable together at the far ends thereof with strap hook and pile fastener sections.

It is a still further object of the invention to provide a forearm crutch cushion system that accomplishes both of the above objects in combination.

Accordingly, a forearm crutch cushion system is provided. The forearm crutch cushion system includes an arm cradle cushion assembly and a hand grip cushion assembly; the arm cradle cushion assembly including a rectangular shaped, padded forearm contact section having an interior facing surface; left and right rectangular top fold-over securing sections formed along a top edge of the padded forearm contact section, each top fold-over securing section having an interior facing surface having a cradle end attaching hook and pile fastener section provided along each of two parallel oriented, top fold-over spaced facing edges thereof that are perpendicular to the top edge of the forearm contact section, the two top fold-over spaced facing edges defining a top vertical support pole notch therebetween; left and right rectangular bottom fold-over securing sections formed along a bottom edge of the padded forearm contact section, each bottom fold-over securing section having an interior facing surface having a hook and pile fastener strip provided thereon that is collinearly oriented with the hook and pile fastener strip provided on the interior facing surface of the other bottom fold-over securing section, both hook and pile fastener strips being positioned adjacent to the bottom edge of the padded forearm contact section, the left and right bottom fold-over securing sections having two parallel oriented, bottom fold-over spaced facing side edges that are each collinear with one of the two top fold-over spaced facing edges and that define a bottom vertical support pole notch; and rectangular, left and right cradle end cover sections formed respectively in connection with left and right side edges of the padded forearm contact section; the exterior side of the left and right rectangular top fold-over securing sections having top fold-over securing section edges having top hook and pile fastener strips provided adjacent thereto that are each companionate with the hook and pile fastener strips of the bottom fold-over securing sections; the left and right cradle end cover sections each having a far end provided with a cradle end hook and pile fastener section on the exterior side thereof that is companionate with the cradle end attaching hook and pile fastener sections of the top fold-over securing sections; the hand grip cushion assembly including a rectangular shaped, padded hand grip section with an interior side hand grip hook and pile faster strip provided along a bottom edge thereof and an exterior side hand grip hook and pile faster strip provided along the top edge thereof that is companionate with the interior hand grip hook and pile faster strip; the hand grip cushion assembly including first and second vertical crutch support pole securing straps that are attachable together at the far ends thereof with strap hook and pile fastener sections.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein:

FIG. 1 is a plan view of the interior facing surface of an exemplary embodiment of the arm cradle cushion assembly of the forearm crutch cushion system of the present invention showing the interior side of the rectangular shaped, padded forearm contact section; the interior side of the left and right rectangular top fold-over securing sections formed along a top edge of the padded forearm contact section, each top fold-over securing section having a cradle end attaching hook and pile fastener section provided along two parallel oriented, top fold-over spaced facing edges thereof that are perpendicular to the top edge of the forearm contact section, the two top fold-over spaced facing edges defining a top vertical support pole notch therebetween; the interior side of the left and right rectangular bottom fold-over securing sections formed along a bottom edge of the padded forearm contact section, each bottom fold-over securing section having a hook and pile fastener strip provided thereon that is collinearly oriented with the hook and pile fastener strip provided on the other bottom fold-over securing section, both hook and pile fastener strips being positioned adjacent to the bottom edge of the padded forearm contact section, the left and right bottom fold-over securing sections having two parallel oriented, bottom fold-over spaced facing side edges that are each collinear with one of the two top fold-over spaced facing edges and that define a bottom vertical support pole notch; and the interior side of the rectangular, left and right cradle end cover sections formed respectively in connection with left and right side edges of the padded forearm contact section.

FIG. 2 is a plan view of the exterior facing surface of the exemplary arm cradle cushion assembly of FIG. 1 showing the exterior side of the rectangular shaped, padded forearm contact section; the exterior side of the left and right rectangular top fold-over securing sections, the top fold-over securing section edges having top hook and pile fastener strips provided adjacent thereto that are each companionate with the hook and pile fastener strips of the bottom fold-over securing sections; the exterior side of the left and right rectangular bottom fold-over securing sections; and the exterior side of the left and right cradle end cover sections, each left and right cradle end cover section having a far end provided with a cradle end hook and pile fastener section that is companionate with the cradle end attaching hook and pile fastener sections of the top fold-over securing sections.

EXEMPLARY MODE FOR CARRYING OUT THE INVENTION

Figure 3:
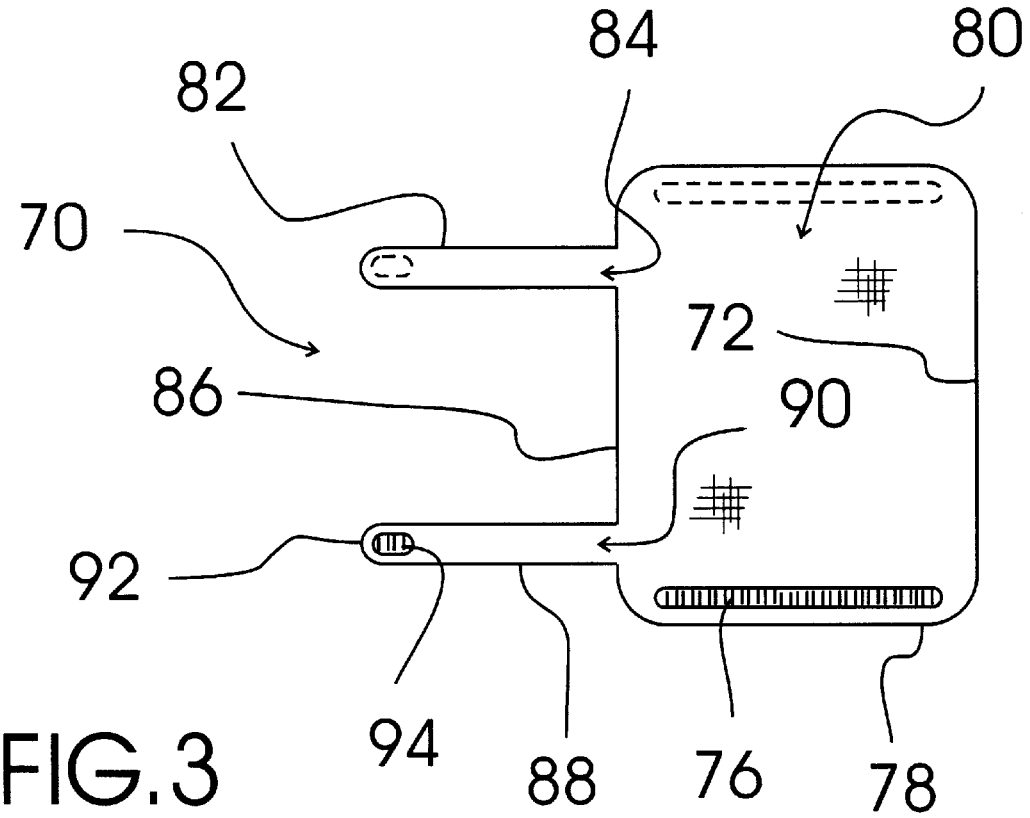
FIG. 3 is a plan view of an exemplary embodiment of the hand grip cushion assembly of the forearm crutch cushion system of the present invention showing the interior side of the rectangular shaped, padded hand grip section with an interior hand grip hook and pile faster strip provided along a bottom edge thereof; the interior side of a first vertical crutch support pole securing strap extending perpendicularly from a top portion of a left side edge of the padded hand grip section; and the interior side of a second vertical crutch support pole securing strap extending perpendicularly from a center portion of a left side edge of the padded hand grip section and spaced from and oriented in parallel with the first vertical crutch support pole securing strip, the far end of the interior side of the second vertical crutch support pole securing strap having a strap hook and pile fastener section.

FIG. 1 shows the interior facing side surface, generally designated 10, of an exemplary embodiment of the arm cradle cushion assembly, generally designated 12, of the forearm crutch cushion system of the present invention. Arm cradle cushion assembly 12 includes a rectangular shaped, padded forearm contact section 14; left and right rectangular top fold-over securing sections 16,18 formed along a top edge 20 of padded forearm contact section 14; left and right rectangular bottom fold-over securing sections 22,24 formed along a bottom edge 26 of padded forearm contact section 14; and rectangular, left and right cradle end cover sections 28,30 formed respectively in connection with left and right side edges 32,34 of padded forearm contact section 14.

Each top fold-over securing section 16,18 has a cradle end attaching hook and pile fastener section 36 provided along one of two parallel oriented, top fold-over spaced facing edges 38 thereof that are perpendicular to top edge 20 of forearm contact section 14 and that define a top vertical support pole notch 40 therebetween. The interior side of each of the left and right rectangular fold-over securing sections 22,24 has a hook and pile fastener strip 44 provided thereon that is collinearly oriented with the hook and pile fastener strip 44 provided on the other bottom fold-over securing section 22,24. Both hook and pile fastener strips 44 are positioned adjacent to bottom edge 26 of padded forearm contact section 14. Left and right bottom fold-over securing sections 22,24 have two parallel oriented, bottom fold-over spaced facing side edges 48 that are each collinear with one of the two top fold-over spaced facing edges 38 and that define a bottom vertical support pole notch 50. With reference to FIG. 2, the exterior side 51 of top fold-over securing sections 16,18 have top hook and pile fastener strips 54 positioned adjacent to top side edges 56 thereof. The exterior side of each of the left and right cradle end cover sections 28,30 has a far end 58 provided with a cradle end hook and pile fastener section 60 that is companionate with the cradle end attaching hook and pile fastener sections 36 (FIG. 1) of top fold-over securing sections 16,18.

Figure 4:
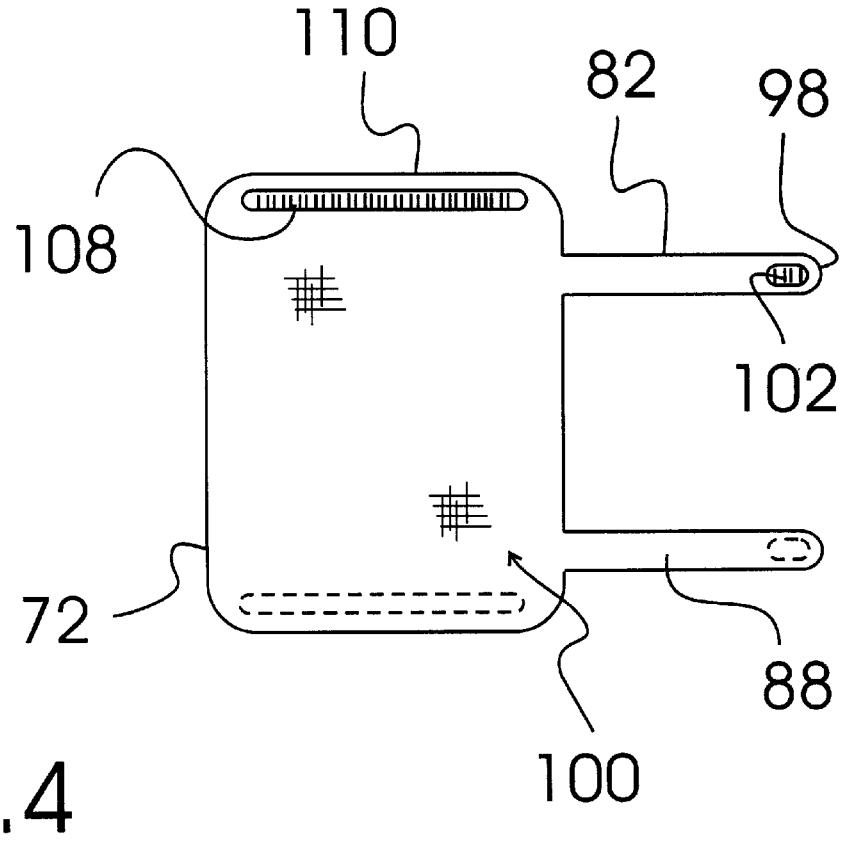
FIG. 4 is a plan view of the exemplary embodiment of the hand grip cushion assembly of FIG. 3 showing the exterior side of the rectangular shaped, padded hand grip section with an exterior hand grip hook and pile faster strip provided along the top edge thereof; the exterior side of a first vertical crutch support pole securing strap, the far end of the exterior side of the first vertical crutch support pole securing strap having an exterior strap hook and pile fastener section that is companionate with the interior strap hook and pile fastener section of the interior side of the second vertical crutch support pole securing strap; and the exterior side of the second vertical crutch support pole securing strap.

FIG. 3 shows an exemplary embodiment of the hand grip cushion assembly, generally designated 70, of the forearm crutch cushion system of the present invention. Hand grip cushion assembly 70 includes a rectangular shaped, padded hand grip section 72 with an interior hand grip hook and pile faster strip 76 provided along a bottom edge 78 of an interior surface 80 thereof. A first vertical crutch support pole securing strap 82 extends perpendicularly from a top portion 84 of a left side edge 86 of padded hand grip section 72. A second vertical crutch support pole securing strap 88 extends perpendicularly from a center portion 90 of left side edge 86 of padded hand grip section 72. Second vertical crutch support pole securing strap 88 is spaced from and oriented in parallel with first vertical crutch support pole securing strap 82. The far end 90 of the interior side of second vertical crutch support pole securing strap 88 has a strap hook and pile fastener section 94 provided thereon. Referring now to FIG. 4, the far end 98 of the exterior side 100 of first vertical crutch support pole securing strap 82 has an exterior strap hook and pile fastener section 102 that is companionate with interior strap hook and pile fastener section 94 (FIG. 3) of second vertical crutch support pole securing strap. An exterior hand grip hook and pile faster strip 108 is provided on the exterior side of padded hand grip section 72 adjacent to a top edge 110 thereof that is companionate with interior hand grip hook and pile faster strip 76 (FIG. 3).

Figures 5, 6:
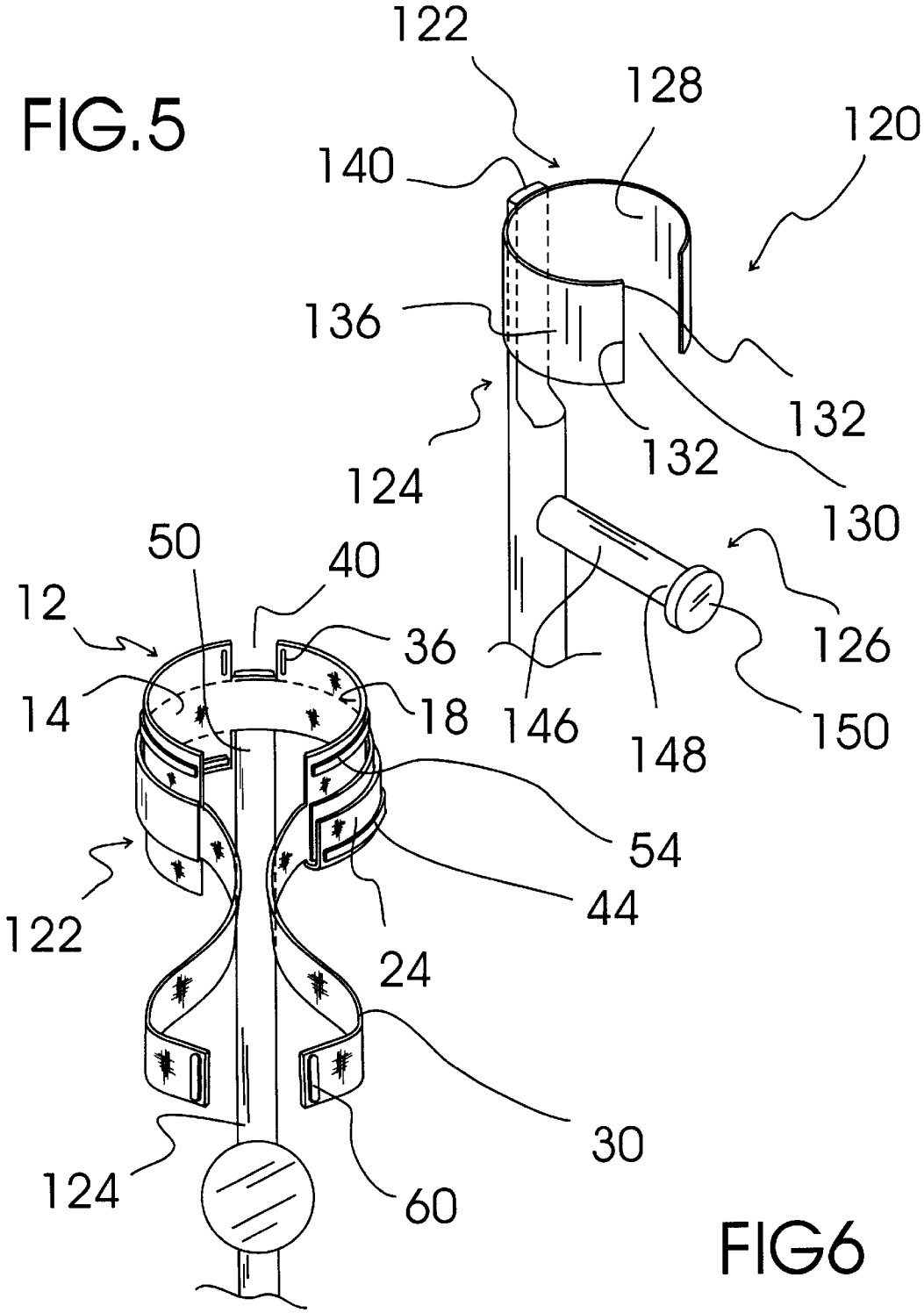
FIG. 5 is a partial perspective view of a representative forearm crutch showing the semi-circular forearm cradle including the interior cradle surface, the cradle insertion opening defined between the two cradle ends and the exterior cradle surface; the vertical crutch support pole extending downward from the center of exterior cradle surface of the forearm cradle; and the cylinder shaped hand grip extending perpendicularly from the vertical crutch support pole and terminating at a far end in an oversized hand grip end cap.
FIG. 6 is a partial perspective view showing the exemplary arm cradle cushion assembly of FIG. 1 partially installed onto the forearm cradle of the representative forearm crutch of FIG. 5 with the exterior side of the rectangular shaped, padded forearm contact section positioned onto the interior cradle surface of the forearm cradle with the vertical crutch support pole aligned with the top vertical support pole notch and the bottom vertical support pole notch; the right rectangular bottom fold-over securing section folded up over the right portion of the exterior cradle surface with the right hook and pile fastener strip provided thereon in position to contact the right top hook and pile fastener strip when the right top fold-over securing section is folded down over the right bottom fold-over securing section, the right cradle end cover section is then foldable over the right top fold-over securing section and the right cradle end hook and pile fastener section attached to companionate right cradle end attaching hook and pile fastener section of the right top fold-over securing section.

FIG. 5 shows a partial view of a representative forearm crutch, generally designated 120 including the semi-circular forearm cradle, generally designated 122; the vertical crutch support pole, generally designated 124; and the hand grip, generally designated 126. Semi-circular forearm cradle 122 includes an interior cradle surface 128, a cradle insertion opening 130 defined between two cradle ends 132 and an exterior cradle surface 136. The top end 140 of vertical crutch support pole 124 is attached to the center of exterior cradle surface 136. Hand grip 126 includes a cylinder shaped shaft 146 that extends perpendicularly from vertical crutch support pole 124 and terminates at a far end 148 in an oversized hand grip end cap 150.

In use, arm cradle cushion assembly 12 is secured to forearm cradle 122 by positioning the exterior side of rectangular shaped, padded forearm contact section 14 onto the interior cradle surface 128 (FIG. 5) with vertical crutch support pole aligned with top vertical support pole notch 40 and bottom vertical support pole notch 50. (While the following discussion is specifically with respect to the right side of arm cradle cushion 12, it is equally applicable to the left side.) Right rectangular bottom fold-over securing section 24 is then folded up over the right portion of the exterior cradle surface 136 (FIG. 5) with the right hook and pile fastener strip 44 in position to contact the right top hook and pile fastener strip 54 when the right top fold-over securing section 18 is folded down over right bottom fold-over securing section 24. Installation of the right side is then completed by folding the right cradle end cover section 30 over the right top fold-over securing section 18 and contacting the right cradle end hook and pile fastener section 60 with companionate right cradle end attaching hook and pile fastener section 36 of right top fold-over securing section 18.

Figure 8:
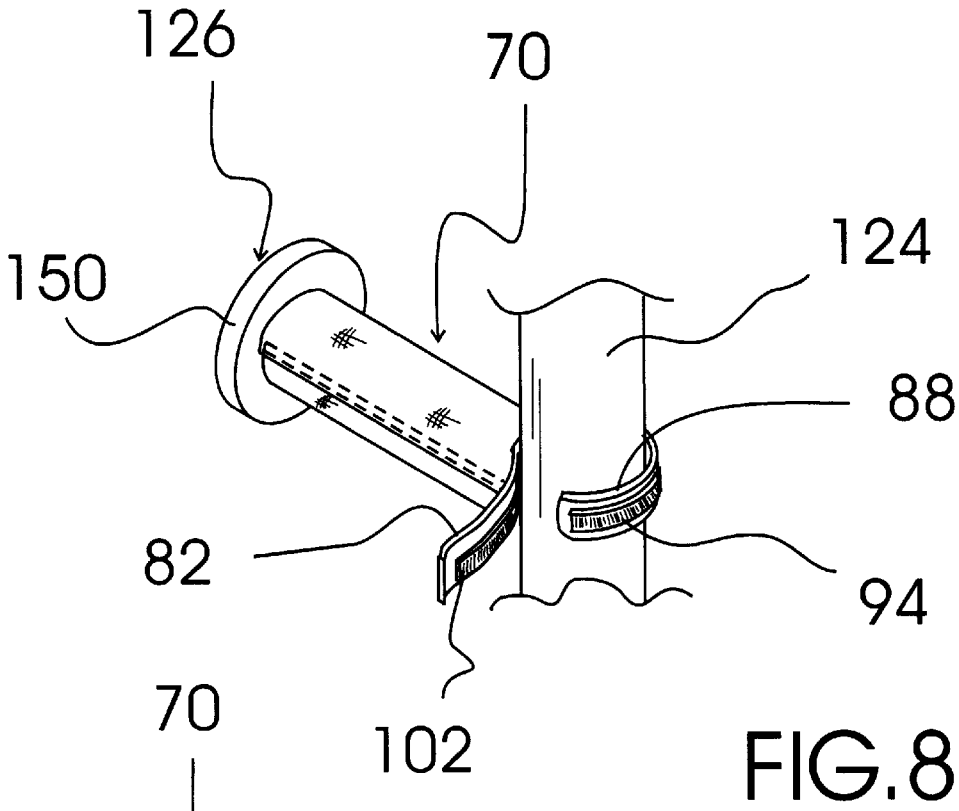
FIG. 8 is partial perspective view showing the hand grip cushion assembly of FIG. 3 with the rectangular shaped, padded hand grip section secured around the cylinder shaped hand grip of the forearm crutch of FIG. 5 and positioned between the vertical crutch support pole and the hand grip end cap; and the first and second vertical crutch support pole securing straps extending partially around the vertical crutch support pole prior to contacting the strap hook and pile fastener sections of the first and second vertical crutch support pole securing straps.
Figure 7:
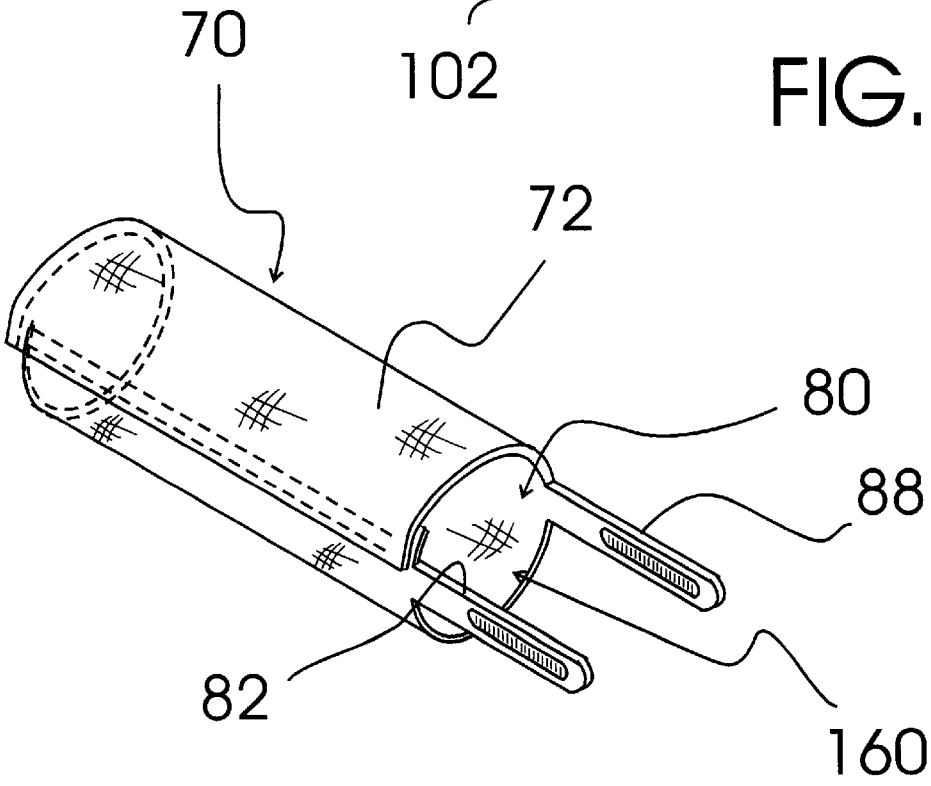
FIG. 7 is a perspective view showing the hand grip cushion assembly of FIG. 3 rolled into a tubular configuration with the interior side of the rectangular shaped, padded hand grip section forming a tubular passageway for receiving the handgrip and the first and second vertical crutch support pole securing straps extending outwardly in parallel from the left side edge of the padded hand grip section.

FIG. 7 shows the padded hand grip section 72 of hand grip cushion assembly 70 rolled into a tubular configuration with the 5 interior surface 80 forming a tubular passageway 160 for receiving the cylinder shaped shaft 146 (FIG. 5), referring now to FIG. 8, of handgrip 126. Padded hand grip section 72 of handgrip cushion assembly 70 is wrapped around hand grip 126 and positioned between vertical crutch support pole 124 and hand grip end cap 150. First and second vertical crutch support pole securing straps 82,88 are then wrapped around vertical crutch support pole 124 and secured together by contacting strap hook and pile fastener sections 102,94 of first and second vertical crutch support pole securing straps 82,88.

It can be seen from the preceding description that a forearm crutch cushion system has been provided that includes an arm cradle cushion assembly and a hand grip cushion assembly; the arm cradle cushion assembly including a rectangular shaped, padded forearm contact section having an interior facing surface; left and right rectangular top fold-over securing sections formed along a top edge of the padded forearm contact section, each top fold-over securing section having an interior facing surface having a cradle end attaching hook and pile fastener section provided along each of two parallel oriented, top fold-over spaced facing edges thereof that are perpendicular to the top edge of the forearm contact section, the two top fold-over spaced facing edges defining a top vertical support pole notch therebetween; left and right rectangular bottom fold-over securing sections formed along a bottom edge of the padded forearm contact section, each bottom fold-over securing section having an interior facing surface having a hook and pile fastener strip provided thereon that is collinearly oriented with the hook and pile fastener strip provided on the interior facing surface of the other bottom fold-over securing section, both hook and pile fastener strips being positioned adjacent to the bottom edge of the padded forearm contact section, the left and right bottom fold-over securing sections having two parallel oriented, bottom fold-over spaced facing side edges that are each collinear with one of the two top fold-over spaced facing edges and that define a bottom vertical support pole notch; and rectangular, left and right cradle end cover sections formed respectively in connection with left and right side edges of the padded forearm contact section; the exterior side of the left and right rectangular top fold-over securing sections having top fold-over securing section edges having top hook and pile fastener strips provided adjacent thereto that are each companionate with the hook and pile fastener strips of the bottom fold-over securing sections; the left and right cradle end cover sections each having a far end provided with a cradle end hook and pile fastener section on the exterior side thereof that is companionate with the cradle end attaching hook and pile fastener sections of the top fold-over securing sections; the hand grip cushion assembly including a rectangular shaped, padded hand grip section with an interior side hand grip hook and pile faster strip provided along a bottom edge thereof and an exterior side hand grip hook and pile faster strip provided along the top edge thereof that is companionate with the interior hand grip hook and pile faster strip; the hand grip cushion assembly including first and second vertical crutch support pole securing straps that are attachable together at the far ends thereof with strap hook and pile fastener sections.

It is noted that the embodiment of the forearm crutch cushion system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A forearm crutch cushion system for forearm crutches having a semi-circular forearm cradle having an interior cradle surface and an exterior cradle surface, a vertical crutch support pole extending downward from the forearm cradle, and a hand grip having a cylinder shaped shaft extending from the vertical crutch support pole, the forearm crutch cushion system comprising:

an arm cradle cushion assembly; and a hand grip cushion assembly;

said arm cradle cushion assembly including:

a rectangular shaped, padded forearm contact section having an interior facing surface;

left and right rectangular top fold-over securing sections formed along a top edge of said padded forearm contact section, each top fold-over securing section having an interior facing surface having a cradle end attaching hook and pile fastener section provided along each of two parallel oriented, top fold-over spaced facing edges thereof that are perpendicular to said top edge of said forearm contact section, said two top fold-over spaced facing edges defining a top vertical support pole notch therebetween;

left and right rectangular bottom fold-over securing sections formed along a bottom edge of said padded forearm contact section, each bottom fold-over securing section having an interior facing surface having a hook and pile fastener strip provided thereon that is collinearly oriented with said hook and pile fastener strip provided on said interior facing surface of said other bottom fold-over securing section, both hook and pile fastener strips being positioned adjacent to said bottom edge of said padded forearm contact section, said left and right bottom fold-over securing sections having two parallel oriented, bottom fold-over spaced facing side edges that are each collinear with one of said two top fold-over spaced facing edges and that define a bottom vertical support pole notch; and rectangular, left and right cradle end cover sections formed respectively in connection with left and right side edges of said padded forearm contact section;

said exterior side of said left and right rectangular top fold-over securing sections having top fold-over securing section edges having top hook and pile fastener strips provided adjacent thereto that are each companionate with said hook and pile fastener strips of said bottom fold-over securing sections;

said left and right cradle end cover sections each having a far end provided with a cradle end hook and pile fastener section on said exterior side thereof that is companionate with said cradle end attaching hook and pile fastener sections of said top fold-over securing sections;

said hand grip cushion assembly including a rectangular shaped, padded hand grip section with an interior side hand grip hock and pile faster strip provided along a bottom edge thereof and an exterior side hand grip hook and pile faster strip provided along said top edge thereof that is companionate with said interior hand grip hook and pile faster strip;

said hand grip cushion assembly further including first and second vertical crutch support pole securing straps than are attachable together at said far ends thereof with strap hook and pile fastener sections;

said arm cradle cushion assembly being installable over the forearm cradle of the forearm crutch such that said rectangular shaped, padded forearm contact section is positioned onto the interior cradle surface of the forearm cradle with the vertical crutch support pole aligned with said top vertical support pole notch and said bottom vertical support pole notch and said right and left rectangular bottom fold-over securing sections are folded over the exterior cradle surface;

said hand grip cushion assembly being installable over the hand grip of the forearm crutch such that said padded hand grip section of said hand grip cushion assembly is rolled into a tubular configuration with said interior surface forming a tubular passageway within which the cylinder shaped shaft of handgrip is positioned and first and second vertical crutch support pole securing straps are wrapped around the vertical crutch support pole and secured together by contacting said strap hook and pile fastener section of said first vertical crutch support pole securing strap with said strap hook and pile fastener section of said second vertical crutch support pole securing strap.

* * * * *